US007210591B2

(12) United States Patent
Goldman et al.

(10) Patent No.: US 7,210,591 B2
(45) Date of Patent: May 1, 2007

(54) NIPPLE WITH A COMPROMISABLE SEAL FOR A BABY BOTTLE

(75) Inventors: Edward J. Goldman, Foxboro, MA (US); Malcolm E. Taylor, Pepperell, MA (US); James J. Britto, Westport, MA (US); John Depiano, Burlington, MA (US); Tuan A. Nguyen, Woburn, MA (US)

(73) Assignee: The First Years Inc., Avon, MA (US)

( * ) Notice: Subject to any disclaimer, the term of this patent is extended or adjusted under 35 U.S.C. 154(b) by 0 days.

(21) Appl. No.: 10/774,873

(22) Filed: Feb. 9, 2004

(65) Prior Publication Data

US 2004/0245203 A1 Dec. 9, 2004

Related U.S. Application Data

(63) Continuation of application No. PCT/US02/25383, filed on Aug. 9, 2002.

(60) Provisional application No. 60/311,219, filed on Aug. 9, 2001.

(51) Int. Cl.
*A61J 9/00* (2006.01)
*A61J 11/00* (2006.01)

(52) U.S. Cl. ..... 215/11.1; 215/11.4; 220/714

(58) Field of Classification Search ..... 215/11.1, 215/11.4; 220/714
See application file for complete search history.

(56) References Cited

U.S. PATENT DOCUMENTS 2,600,978 A * 6/1952 Demarco, Jr. ..... 215/11.1
2,774,500 A * 12/1956 Budiani ..... 215/11.1
2,982,432 A * 5/1961 Mehl ..... 215/11.1
2,987,209 A 6/1961 Leonard
3,070,249 A * 12/1962 Schrwald ..... 215/11.1
3,134,494 A * 5/1964 Quinn ..... 215/11.3
3,552,605 A * 1/1971 Hein ..... 222/207
3,655,083 A * 4/1972 Eberhardt et al. ..... 215/11.5
3,924,620 A * 12/1975 Seunevel ..... 215/11.1
4,420,101 A * 12/1983 O'Neill ..... 222/212
4,586,621 A * 5/1986 Dahan ..... 215/11.1
4,623,069 A * 11/1986 White ..... 215/11.1
5,295,597 A * 3/1994 Green ..... 215/11.4

(Continued)

FOREIGN PATENT DOCUMENTS

EP 0384394 A2 * 8/1990

(Continued)

*Primary Examiner*—Sue A. Weaver
(74) *Attorney, Agent, or Firm*—Michael Best & Friedrich LLP

(57) ABSTRACT

A nipple for a baby bottle includes both inner and outer separable members. The inner member defines a valve passage that can be selectively obstructed by a flap of the outer member. The outer and inner members have respective flexible membranes that define a holding chamber having the valve passage as an inlet and an aperture at the tip of the outer member as an outlet. The flap inhibits flow from the holding chamber through the valve passage when the outer member is compressed, and deflects away from the valve passage to allow the holding chamber to receive a fluid through the valve passage when the outer member is released.

24 Claims, 7 Drawing Sheets

U.S. PATENT DOCUMENTS

| | | | | | |
|---|---|---|---|---|---|
| 5,553,726 | A * | 9/1996 | Park | 215/11.4 |
| 5,747,083 | A * | 5/1998 | Raymond et al. | 426/117 |
| 5,860,541 | A * | 1/1999 | McIntyre et al. | 215/11.4 |
| 6,176,380 | B1 * | 1/2001 | Glories et al. | 215/11.1 |
| 2002/0063103 | A1 * | 5/2002 | Kiernan | 215/11.4 |
| 2004/0035815 | A1 * | 2/2004 | Webb et al. | 215/11.4 |

FOREIGN PATENT DOCUMENTS

| | | | |
|---|---|---|---|
| EP | 0555165 | A1 * | 8/1993 |
| GB | 2131301 | A * | 6/1984 |
| GB | 2169210 | A * | 7/1986 |
| WO | WO 00/48491 | * | 8/2000 |

* cited by examiner

NIPPLE WITH A COMPROMISABLE SEAL FOR A BABY BOTTLE

CROSS-REFERENCE TO RELATED APPLICATIONS

This application is a continuation application of International Application Number PCT/US02/25383, filed Aug. 9, 2002, and U.S. Provisional Application Ser. No. 60/311,219, filed Aug. 9, 2001, the entire contents of which are incorporated herein by reference.

TECHNICAL FIELD

This invention relates to a nipple for a baby bottle.

BACKGROUND

A wide variety of baby bottle nipples exist. The nipples can typically be coupled to a container storing a fluid, such as milk, formula, juice or water. These nipples are typically somewhat elastic and include a hole to allow passage of the fluid from the container to a baby.

Fluids can be delivered to a baby, for example, by using commercially available nipples secured to a container of fluid or by allowing a baby to suckle directly from a breast of a nursing mother.

Improvements are continually sought in the design of artificial bottle nipples to try to replicate the function and feel of the natural nipple, in part to help ease transitions between breastfeeding and bottle feeding.

SUMMARY

In one broad aspect of the invention, a nipple for use with a baby bottle includes a flexible outer member and an inner member. The outer member has an annular securing flange and a central membrane portion extending from the securing flange to define an aperture at a nursing end thereof. The central portion has an inner surface and a flexible flap extending inwardly from the inner surface. The inner member has a flexible membrane portion positioned at least partially within the central portion of the outer member and defines a valve passage arranged to be selectively obstructed by the flap. The outer member and the inner member define between them a holding chamber having the valve passage as an inlet and the aperture as an outlet. The flap is positioned on a side of the passage nearest the holding chamber to inhibit flow from the holding chamber through the passage when the outer membrane is compressed to collapse the holding chamber, and to deflect away from the passage to allow the holding chamber to receive a fluid through the passage when the outer membrane is released.

In some cases, the flap defines a hole and is manually positionable to align the hole with the valve passage to establish a hydraulic communication path into the holding chamber. In some such cases, the membrane portion of the outer membrane member has an outer exposed surface with a delineated region adjacent the flap, the delineated region of the outer member being manipulable to move the flap to align the hole with the valve passage.

Preferably, the holding chamber includes a first section that receives the fluid when the outer membrane is released; a second section in hydraulic communication with the aperture; and a compromisable seal disposed between the first and second sections. The seal prevents passage of fluid when the membrane of the outer membrane member is in a relaxed position, and allows passage of fluid when the membrane of the outer membrane member is compressed to collapse the holding chamber. In some instances the compromisable seal is defined by an annular portion of the membrane of the outer member that contacts an annular portion of the membrane of the inner member.

In some embodiments the aperture provides a hydraulic communication path for passing fluid out of the holding chamber when the membrane of the outer membrane member is compressed.

The aperture may be in the form of a slit, for example, in the outer membrane, that opens to allow passage of fluid when the outer membrane is compressed and closes to prevent passage of fluid when the outer membrane is in a relaxed position.

In a presently preferred embodiment, the nipple has a plurality of valve passages, and a plurality of corresponding flaps, with each valve passage selectively obstructed by a corresponding flap. Preferably two of the flaps, positioned opposite each other, define priming holes and are manipulable to align their priming holes with respective valve passages to establish a hydraulic communication path into the holding chamber. More preferably, the outer membrane further has an outer surface with a delineated region adjacent each hole-defining flap, each delineated region being manipulable to move the associated flap to align the associated hole with the associated passage.

The membrane of the inner member preferably is of a hardness of about 50 shore A, and the membrane of the outer member is preferably of a hardness of about 55 shore A.

In a preferred constructions, the inner member includes a rigid base ring from which the flexible membrane of the inner member extends. Preferably, the membrane of the inner member is formed of a flexible material that extends across a lower surface of the base ring to form a gasket seal for engaging an upper rim of a bottle. The base ring, in some cases, defines recesses arranged to receive alignment features of the outer member, to rotationally align the inner and outer members.

The inner and outer members may also be integrally formed (e.g., molded) of a single resin.

It is preferred that at least the membrane of the inner member be removable from within the outer member, such as for cleaning or for use of the outer member as a standard nipple. More preferably, the two members are completely separable for cleaning and/or replacement.

In some embodiments, corresponding alignment patterns are provided on the annular securing flanges of the inner and outer members, such that relative positioning of the patterns indicates a degree of rotational alignment between the inner and outer members.

In some cases, the aperture is positioned offset from an axial centerline of the outer membrane by a distance (e.g., of between about 1 and 15 millimeters) measured along the contour of the nipple.

In some cases, the membrane of the inner member defines an orifice sized to pass a small amount of fluid when suction is applied to the aperture of the membrane of the outer member.

Another aspect of the invention features a bottle for feeding a baby. The bottle includes a container for holding a fluid that has an open end for passage of the fluid, a nipple as described above, and a securing device positioned to mate with the securing flange of the outer member of the nipple to secure the nipple to the open end of the container.

Another aspect of the invention features a method of delivering fluid to a baby. The method includes securing a nipple (as described above) to an open end of a container holding a fluid, and positioning the aperture of the nipple inside a baby's mouth, thereby enabling the baby's mouth to apply a compressive force to the outer membrane to collapse the membrane of the outer member to force fluid from the holding chamber, through the aperture. The baby's mouth can then release the outer membrane, thereby enabling the holding chamber to receive more fluid from the container through the valve passage.

In some cases the method includes, preferably prior to positioning the aperture of the nipple inside the baby's mouth, manually priming the nipple. Priming the nipple includes, in some cases, positioning the container so that the fluid is in contact with the nipple and manually manipulating a delineated region on an outer surface of the outer member, such as by compressing the delineated region, to move the flap to align a hole in the flap with the passage. In some instances priming the nipple includes allowing fluid to flow from the container, through the valve passage, through the hole in the flap and into the holding chamber while the hole remains aligned with the valve passage. The delineated region may be released to return the flap to a position with its hole offset from the valve passage and the flap obstructing the passage.

In some applications, securing the nipple includes aligning rotational alignment features of the inner and outer members to place the inner and outer members in operative relative alignment.

Yet another aspect of the invention features a method of priming a nipple for a baby bottle. The method includes securing one of the above-described nipples to an open end of a container holding a fluid, orienting the bottle so that the fluid is in contact with the nipple, and applying a compressive force to the delineated region of the outer member to deform the outer member in such a manner that the hole of the flap aligns with the valve passage of the inner member.

The term static, as used herein to describe a condition associated with a nipple, should be understood to include any condition that the nipple or any component of the nipple is not under the influence of any externally applied forces as might be applied by a mother or a baby.

Implementation of the techniques and apparatus described herein may provide one or more of the following advantages. A nipple may be provided that can closely approximate the function and response of a mother's nipple when breastfeeding. Babies may be more comfortable learning how to be fed by a bottle after having been breastfed. Transitioning a baby from a regimen including breastfeeding to a regimen including bottle feeding may be made less traumatic for the baby and easier for the parent teaching the baby. Implementations including a compromisable seal can desirably minimize the amount of fluid that might leak from the nipple in the event that the baby bottle is, for example, dropped or knocked over.

Other advantages and aspects will be apparent from the following disclosure of embodiments and from the claims.

DESCRIPTION OF DRAWINGS

Like reference symbols in the various drawings indicate like elements.

DETAILED DESCRIPTION

Figure 1:
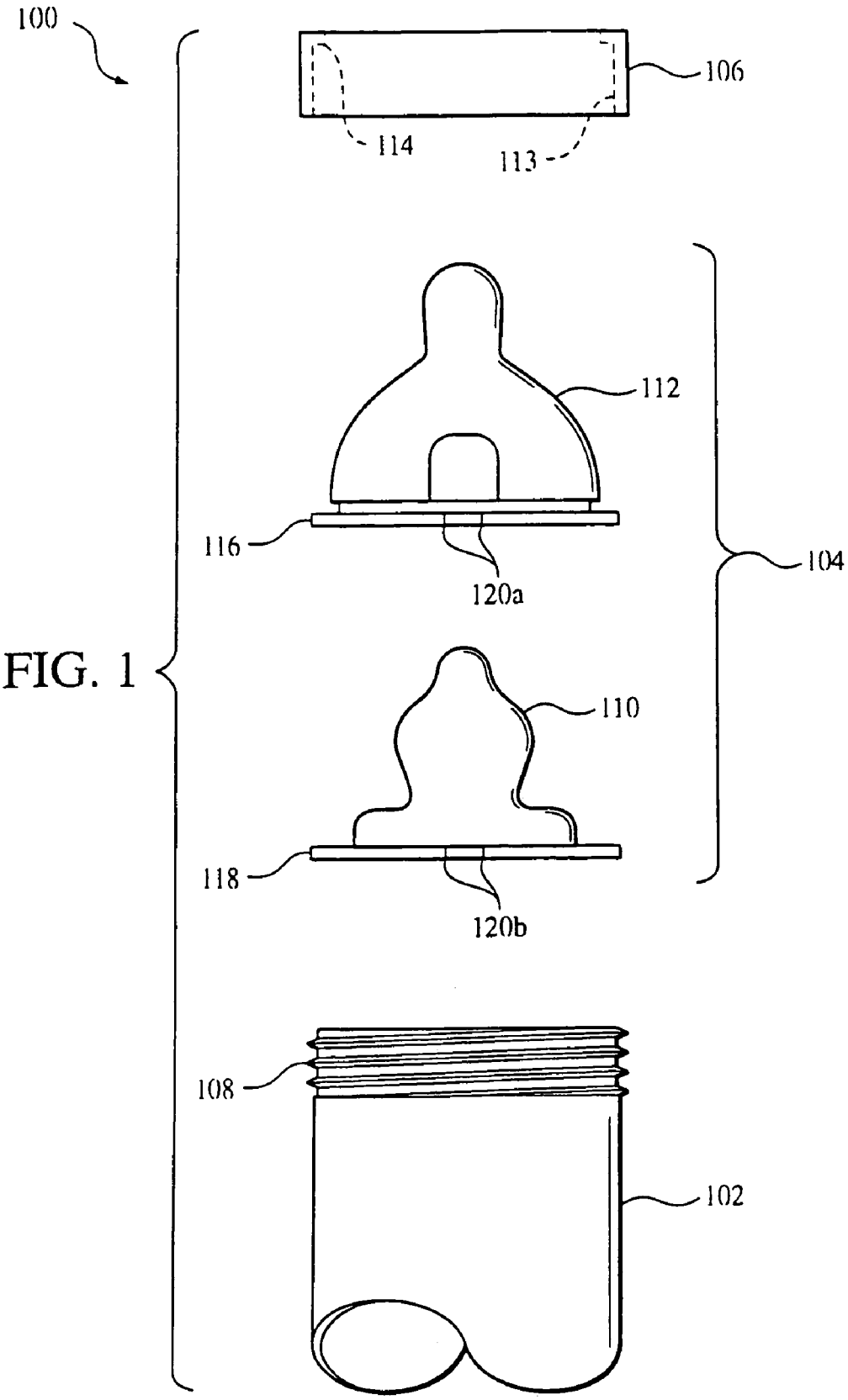
FIG. 1 is a partial exploded side view of a baby bottle assembly.

As shown in FIG. 1, a baby feeding assembly 100 includes a container 102 for holding a fluid, such as milk or water. A nipple 104 mates with an open end of the container 102 and a securing device 106 secures the nipple 104 to the open end of the container 102.

The nipple 104 includes an inner member 110 and an outer member 112. When assembled, the inner member 110 is positioned at least partially within the outer member 112. The outer member 112 may also be installed on the bottle without the inner member, for use as a standard one-piece nipple.

The securing device 106 has threads 113 disposed on an internal surface that can mate with corresponding threads 108 on an outer surface on the container 102. The nipple 104 can be positioned between the securing device 106 and the container 102. The securing device 106 can be fastened to the container 102. When so assembled, an internal collar 114 of the securing device 106 contacts an annular flange 116 of the outer member 112 to compress it and also to compress an annular flange 118 of the inner member 110, thereby securing the nipple 104 to the container 102. Other securing techniques known to those possessing ordinary skill in the art may be possible.

Alignment marks 120*a*, 120*b* are provided on securing flanges 116, 118 of both the outer membrane 112 and the inner membrane 110. When assembled, the alignment marks 120*a*, 120*b* of each flange 118, 116 should align with each other. The alignment marks 120*a*, 120*b* can provide an indication that the inner member 110 and the outer member 112 are in proper relative alignment with each other.

Figure 2A:
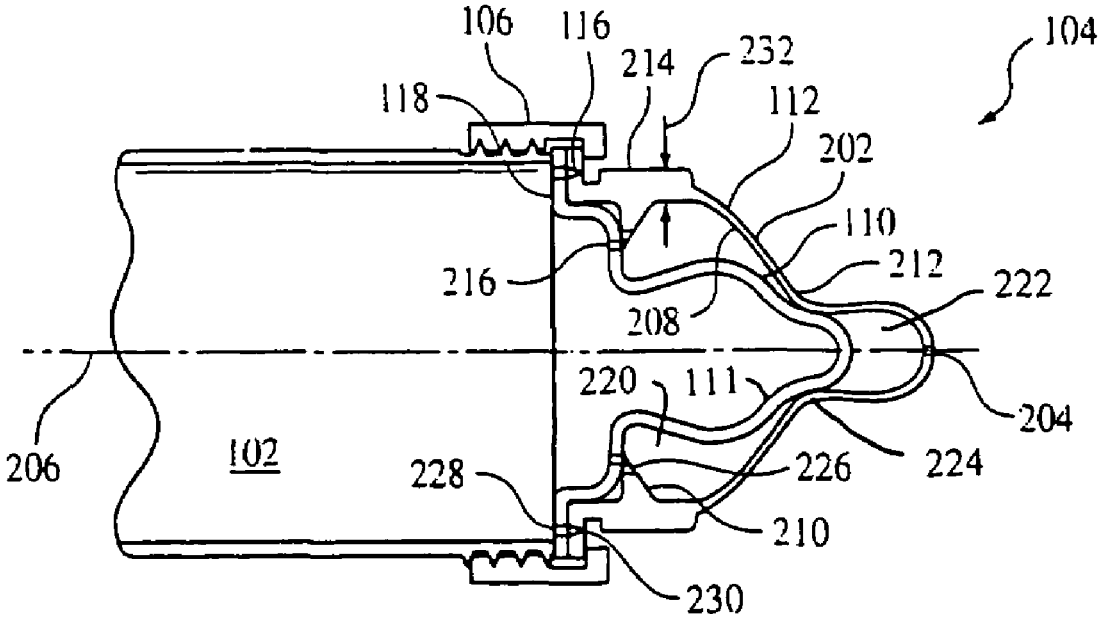
FIG. 2A is a cross-sectional view of the assembled nipple shown in FIG. 1.

FIG. 2A shows the assembled nipple 104 in a static condition. The nipple 104 is securely fastened to a container 102 by securing device 106. The annular securing flange 116 of the outer member 112 is in contact with the annular securing flange 118 of the inner member 110 and the inner member 110 is positioned partially within the outer member 112. The outer member 112 includes a central membrane portion 202 that extends from the securing flange 116 to define an aperture 204 at the nursing end. The aperture 204 could be, for example, a centrally disposed hole positioned at an intersection of an axial centerline 206 of the nipple 104 and membrane 202 to allow passage of fluid from the container 102. Alternatively, the aperture 204 could be a slit in membrane 202. The slit could, for example, open to allow passage of fluid when the membrane portion of the outer member is compressed, and close to inhibit passage of fluid when the outer member is in its static position. The slit could be configured, for example, with an I-shape or an X-shape.

Optionally, one or more apertures 204 could be disposed a distance off-center from the intersection of the longitudinal axis 206 of the nipple with outer member membrane portion 202. Offsetting the aperture in this manner may be desirable to prevent fluid that exits the aperture 204 from being directed towards a baby's throat. An aperture 204 may be displaced, for example, between about 0 millimeter and 15 millimeters from the intersection of the longitudinal axis 206 with membrane 202 as measured along the contour of the membrane. More preferably, apertures 204 may be displaced between about 0 and 5 millimeters, and most preferably may be displaced between about 2 and 4 millimeters from the centerline of the nipple. Additionally, aperture 204 may be displaced from the intersection of the longitudinal axis and the outer membrane by an angle measured from a point along the longitudinal axis inside the outer member that is approximately 15 millimeters from the outer member. The apertures are preferably positioned such that the angle is between about 0 degrees and 90 degrees (more preferably between about 0 and 30 degrees and most preferably between about 5 and 15 degrees).

The central membrane portion 202 of outer member 112 has an inner surface 208 from which flexible flaps 210 extend inwardly. The inner member 110 includes valve passages 216 that can be selectively obstructed by corresponding flaps 210 extending from the outer member 112. In this embodiment, flaps 210 include a hole 226 that, in a static state, is axially offset from a corresponding passage 216, but can be manually shifted to prime the nipple.

Inner member 110 has a central membrane portion 111 extending into the membrane portion 202 of the outer member 112.

The outer surface 212 of the outer member 112 includes two delineated regions 214, each positioned on an opposite side of the nipple 104. The delineated regions 214 are adjacent to and associated with corresponding flaps 210 that define priming holes 226 and are raised from the surrounding surface of the outer membrane for easy manual manipulation.

The securing flange 118 of the inner member 110 includes vent holes 228, positioned annularly at intervals annularly around the perimeter of the securing flange 118. Corresponding vent holes 230 are provided in the outer member 112 to be aligned with the vent holes 228 of the inner member 110 to define a sealable path for passage of air. If so provided, the path should be sufficiently narrow to prevent inadvertent leakage of fluid out of the container. As fluid exits the container 102 through valve passages 216, a low pressure region is created within the container. If a sufficient pressure difference is created between the external atmospheric pressure and a container 102, the vent path should allow for the passage of air into the container to equalize the pressure difference. Other venting arrangements are possible and will be apparent to one possessing ordinary skill in the art.

The inner member 110 and the outer member 112 can be fabricated using flexible, safe, non-toxic materials. Suitable materials include, for example, thermoplastic elastomers (TPE) and silicone. Silicone is preferred for outer member 112.

Inner member 110 has a substantially uniform material thickness throughout. Alternative arrangements may include inner members having a thickness that varies throughout. The thickness of inner member 110 material typically ranges between about 0.020 inch (0.5 millimeter) and 0.100 inch (2.5 millimeters), but is more preferably between about 0.060 inch (1.5 millimeters) and 0.080 inch (2.0 millimeters).

Preferably, the delineated regions 214 of outer member 112 are structurally reinforced and more rigid compared to other portions of the outer member 112. Accordingly, the thickness of delineated regions 214, as measured at the area indicated approximately by the arrows 232, is preferably between about 0.060 inch and 0.100 inch (between about 1.5 and 2.5 millimeters), but is more preferably about 0.080 inch (2.0 millimeters). The other portions of the outer member 112 (i.e., not delineated regions 214) preferably have a uniform thickness that ranges from about 0.020 inch (0.5 millimeter) to about 0.050 inch (1.3 millimeters), but more preferably ranges from about 0.030 inch (0.8 millimeter) to about 0.040 inch (1.0 millimeter).

In some implementations, it may be desirable for the membrane portion of inner member 110 to be more rigid than nominal portions (e.g., any portion other than delineated regions 214) of the membrane portion of outer member 112.

Figure 2B:
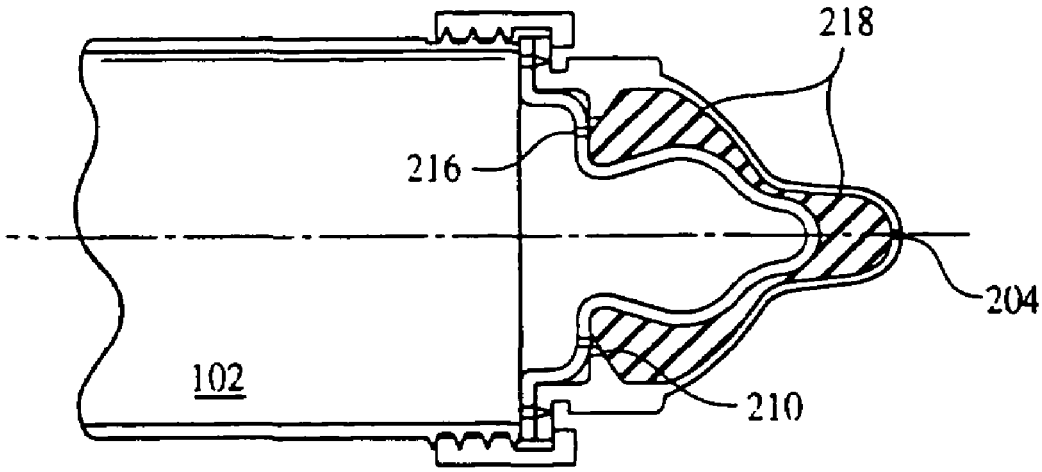
FIG. 2B shows a version of the nipple assembly without a compromisable seal.

Referring now to FIG. 2B, outer member 112 and inner member 110 define a holding chamber 218 between them. The holding chamber 218 has valve passages 216 as inlets and aperture 204 as an outlet. The flaps 210 are positioned on a side of passages 216 closest to the holding chamber 218 and may, in fact, be positioned within the holding chamber 218 proper. The holding chamber 218 can be a single contiguous space with fluid being allowed to flow freely throughout all areas of the holding chamber 218.

In some cases, as shown in FIG. 2A, a compromisable seal 224 is defined by an annular portion of the membrane portion 202 of outer membrane 112 contacting a corresponding annular portion of the membrane portion of inner member 110 to create a fluid-tight and air-tight seal 224 when the nipple 104 is in a relaxed state. The compromisable seal 224 divides the holding chamber 218 into a first section 220 and a second section 222. The first section 220 is able to receive fluid directly from the container 102, through valve passages 216. The second section 222 is in direct hydraulic communication with aperture 204 and can receive fluid from the first section 220 when the seal 224 is compromised, such as when the outer membrane 112 is compressed or otherwise deformed.

Figure 3A:
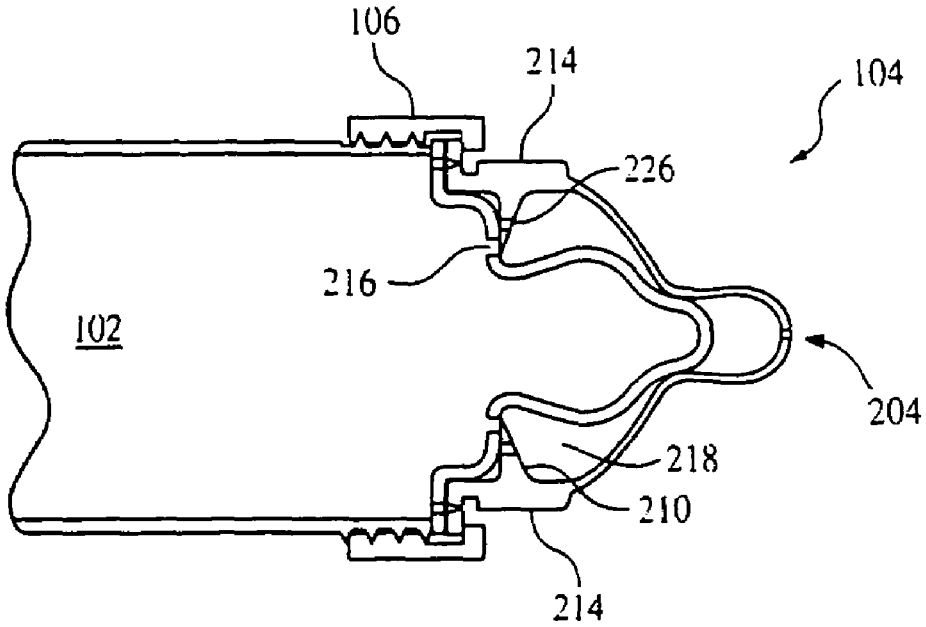
FIG. 3A shows the nipple assembly in a static condition.

Referring now to FIG. 3A, nipple 104 is secured to a container 102 with a securing device 106. The container 102 is holding a fluid. The flaps 210 are positioned to obstruct valve passages 216 and thereby prevent the flow of fluid from the container into the holding chamber 218. The holding chamber 218 is initially void of fluid.

Prior to delivering fluid to a baby, nipple 104 may require priming to initially introduce an amount of fluid into the holding chamber 218, preferably to completely fill holding chamber 218. Priming may not be required in all applications.

Figure 3B:
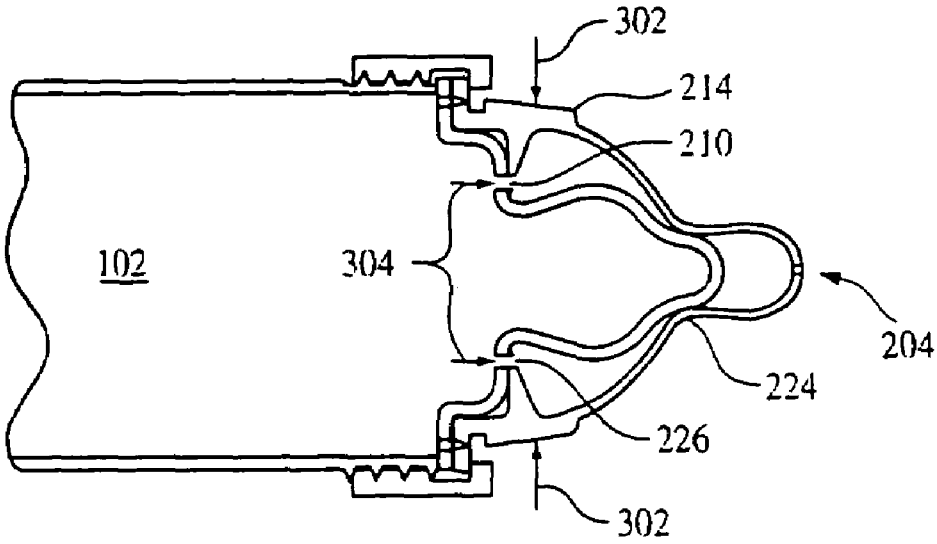
FIG. 3B shows the nipple assembly during priming.

Referring now to FIG. 3B, each delineated region 214 can be manually manipulated by applying a force, for example by compressing the opposing delineated regions 214 of nipple 104 between thumb and forefinger, in a direction indicated by the arrows 302. Applying such a force causes the delineated regions 214 to move inwardly, thereby moving their associated flaps 210 so that corresponding holes 226 in the flaps 210 align with valve passages 216 in inner member 110. This establishes a hydraulic communication path between the container 102 and the holding chamber 218. Fluid can flow freely from the container 102 into the holding chamber 218 as indicated by the arrows 304 as long as holes 226 and valve passages 216 are held in alignment.

When the applied force is released, the outer member regains its original shape and flaps 210 return to their original positions to obstruct passages 216, as in FIG. 3A. The holes 226 in the flaps 210 are once again offset from their associated valve passages 216 in the inner member 110. The flaps 210 return to their original positions due to the elasticity of the flexible portion of the outer member 112.

Figure 4A:
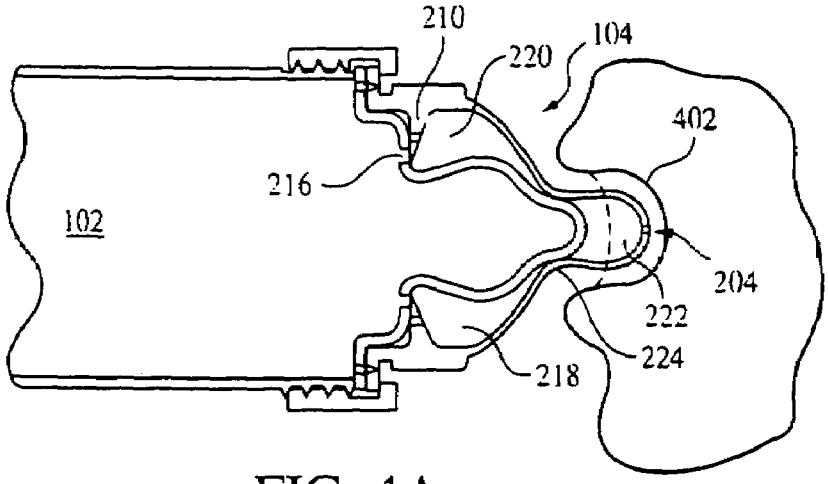
FIGS. 4A–4C sequentially illustrate nipple insertion into a baby's mouth and suckling.

Referring now to FIG. 4A, a caregiver can position aperture 204 of the primed nipple 104 inside a baby's mouth 402 to enable the baby to draw fluid from nipple 104. The illustrated container 102 is holding a fluid, and the holding chamber 218 of the nipple 104 is fully primed with fluid. The flaps 210 are positioned to prevent passage of fluid from the holding chamber back into the container 102, through valve passages 216.

Figure 4B:
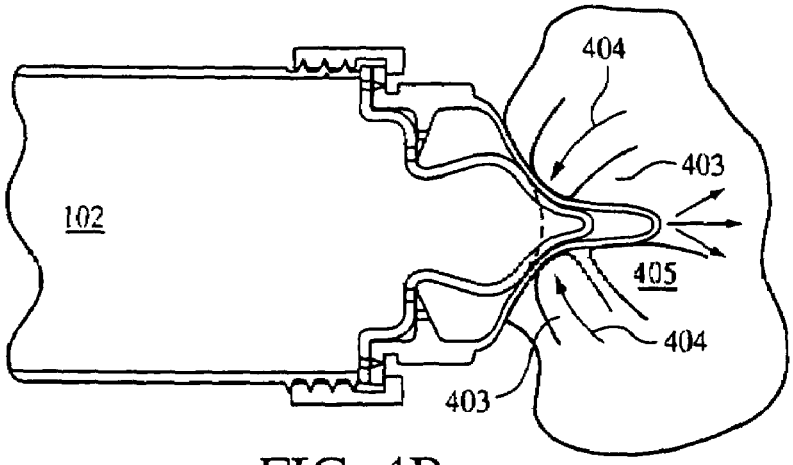

Turning to FIG. 4B, with the nipple 104 so positioned, the baby can apply a compressive force to the outer member 112 with its gums 403, in a direction indicated approximately by arrows 404. The compressive force collapses the holding chamber 218, reducing its volume and forcing fluid from the holding chamber 218 through aperture 204 and into the baby's mouth 402. The flaps 210 remain positioned to obstruct valve passages 216, thereby preventing fluid from flowing back into container 102 while holding chamber 218 is being collapsed. Rolling of the baby's tongue 405 against the outer member 112 can further force fluid toward the aperture in a manner similar to the natural mechanisms of drawing milk from mammory gland ducts during breast-feeding.

In implementations in which the holding chamber is divided by a compromisable seal 224, applying the compressive force in a direction indicated by arrows 404 also opens the compromisable seal at least at two positions about the perimeter of the inner member, thereby allowing fluid to flow in a direction indicated by arrows 410 between the first portion 220 of the holding chamber 218 and the second portion 222 of the holding chamber 218.

Figure 4C:
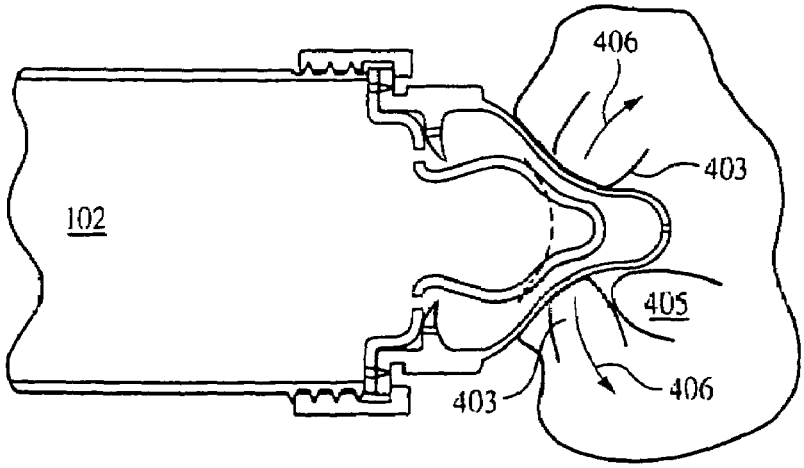

Referring now to FIG. 4C, when the baby's gums 403 and/or tongue 405 sufficiently reduce or release the compressive force, the outer member 112 moves in a direction indicated by arrows 406 to restore at least some of the displaced volume of the holding chamber 218. This action creates a low-pressure region within the holding chamber 218, relative to container 102, that causes the flaps 210 to deflect away from valve passages 216 to establish a hydraulic communication path between the container 102 and the holding chamber 218, pulling fluid from container 102 through passages 216 to holding chamber 218, as indicated by arrows 408. Fluid continues to flow in this manner until the pressure differential across passages 216 is substantially equalized. After the pressure is substantially equalized between container 102 and holding chamber 218, flaps 210 reseat against passages 216 to prevent passage of fluid from container 102 into the holding chamber 218, and the next suckling cycle repeats as in FIG. 4B.

In some implementations, when the compressive force is released by the baby's mouth 402, the compromisable seal 224 is reestablished between the first portion 220 of holding chamber 218 and the second portion 222 of holding chamber 218. This action can effectively isolate the first portion 220 of holding chamber 218 from aperture 204, and thereby minimize undesirable entrance of air through aperture 204 into holding chamber 218 when outer member 112 is released.

Figure 5A:
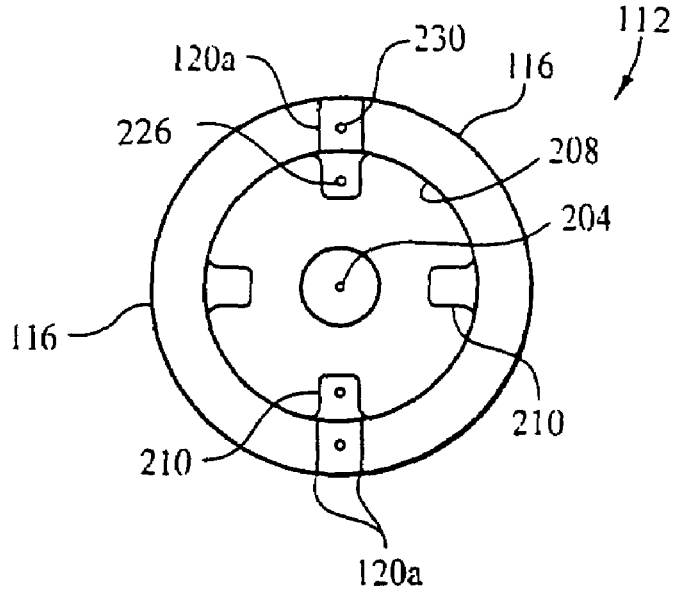
FIG. 5A is a bottom view of the outer member of the nipple of FIG. 1.

Referring now to FIG. 5A, four flexible flaps 210 are located at equal intervals around the perimeter of, and project inwardly from, the inner surface 208 of outer member 112. The outer member can include more or fewer flaps than illustrated. Two of the flaps 210 define holes 226 for priming the nipple. Regardless of how many flaps 210 are included in a particular implementation, preferably only two include holes 226. The two flaps 210 with holes 226 are positioned opposite each other in alignment with priming pads 214 (FIG. 1). This arrangement enables a user to prime the nipple by applying a relatively simple squeezing force with, for example, a thumb and a forefinger. Each flap 210 with a hole 226 is located adjacent a delineated region 214, which provide a means for manipulating flaps 210 to change the positions of holes 226.

Two vent holes 230 are also provided in securing flange 116. An alternative arrangement could include, for example, a channel extending around the perimeter of securing flange 116 and vent holes passing from the channel through the securing flange 116. Other vent arrangements are also possible.

The securing flange 116 includes alignment marks 120*a* to assist a user in aligning the outer membrane 112 with the inner membrane.

Figure 5B:
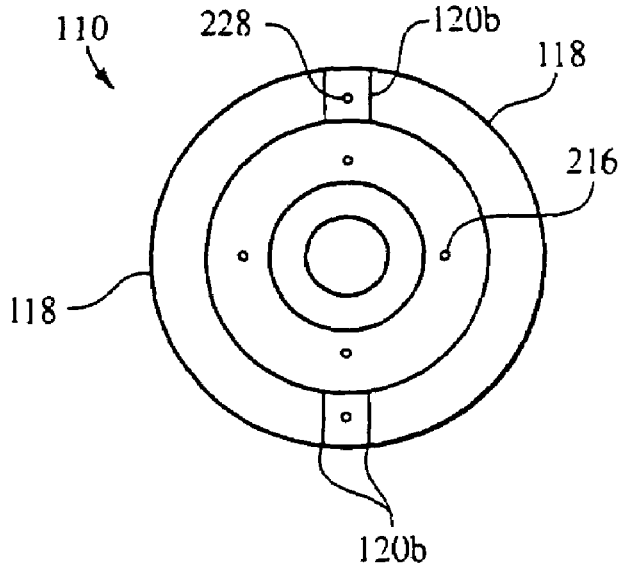
FIG. 5B is a bottom view of the inner member of the nipple of FIG. 1.

Referring also to FIG. 5B, the securing flange 118 of inner member 110 includes alignment marks 120*b* for aligning the inner member with a corresponding outer member. The relative positioning of the alignment marks in an assembled nipple determine the degree of radial alignment between the inner and outer members. Other patterns or features may be provided to facilitate aligning inner and outer members of the nipple, which may be required in some configurations to ensure that the flaps or other flow blocking features of the outer member correctly line up with passages 216, and also to ensure that vent holes 228, 230 align properly. Preferably, marks 120*a* (FIG. 5A) and 120*b* of the inner and outer members comprise mating physical features of the two parts that disallow assembly unless the two pieces are in proper alignment, such as discussed further below. Such mating features may include, for example, male/female type connections.

Four valve passages 216 are defined by inner member 110, positioned at equal intervals around the perimeter of an annular portion of the inner member. When a nipple is assembled, a flap of the outer member normally blocks each passage in a static condition.

Figure 6A:
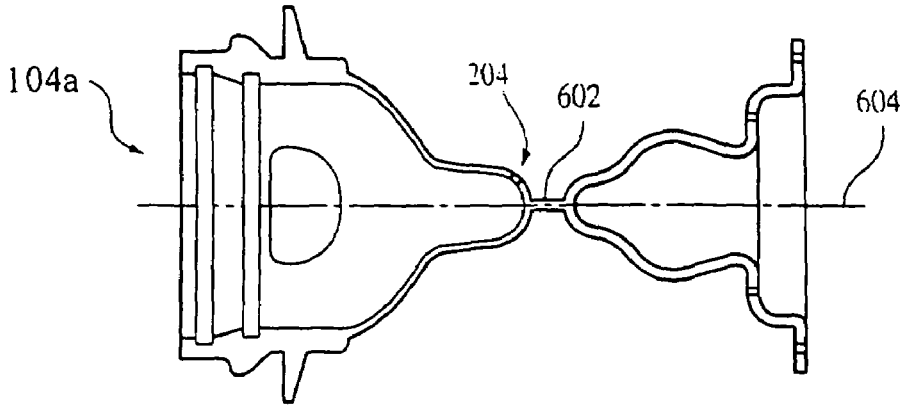
FIG. 6A is a cross-sectional view of a second nipple, with the inner and outer members unitarily molded, in an as-molded condition.
Figure 6B:
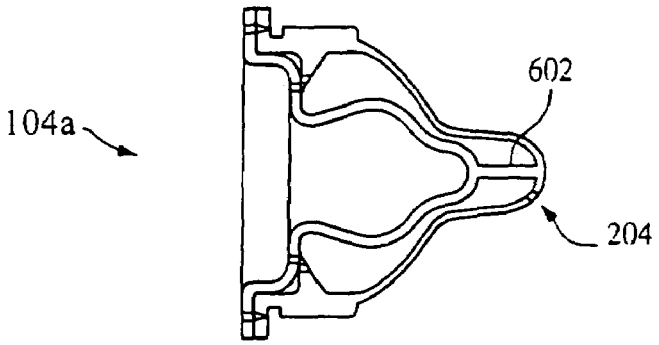
FIG. 6B shows the nipple of FIG. 6A, with the outer member inverted about the inner member for use.

As shown in FIG. 6A, nipple 104*a* can be fabricated as a single integrated structure. Such a structure can be unitarily molded with a connector 602 disposed between the outer membrane portion and the inner membrane portion. The outer membrane portion is shown as molded, and must be inverted to create a functional apparatus, as shown in FIG. 6B. The aperture 204 is offset from an axial centerline 604 of the nipple 104*a* to allow the connector 602 to be configured as shown. Alternative connector 602 configurations may be possible. Alignment marks are not included, because the outer membrane portion remains securely fastened to the inner membrane portions at all times. The connector 602 can ensure proper radial alignment between the outer membrane portion and the inner membrane portion.

Figure 7:
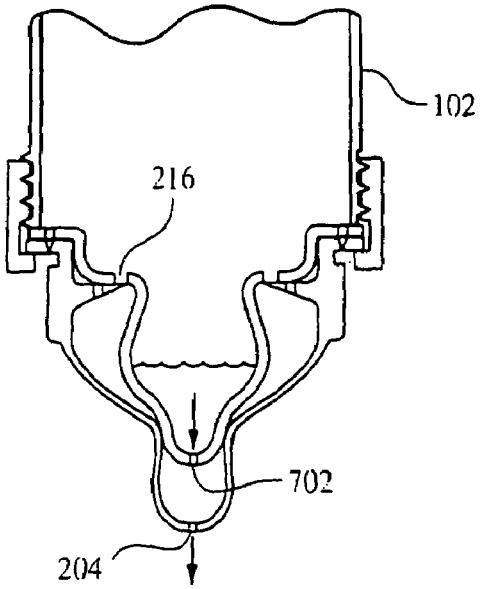
FIG. 7 is a cross-sectional view of a nipple with a hole at the end of the inner member.

Turning now to FIG. 7, in certain implementations it may be desirable to provide a small orifice 702 near the tip of the inner member to allow a small amount of fluid to pass through when suction is applied to aperture 204. Orifice 702 is preferably small enough to inhibit the passage of significant amounts of fluid, but provides a means for removing the small amount of fluid that may remain within the conical portion of the inner member and not readily pulled through passages 216 into the holding chamber. In such cases, the primary means of dispensing fluid from the nipple remains the peristaltic pumping action of the cyclic deformation of the holding chamber, orifice 702 providing only a supplemental flow insufficient to interfere with the pumping function.

In some cases, orifice 702 also serves as an internal pressure regulator during suckling. Excess pressure in the holding chamber causes some return flow into the bottle through orifice 702, limiting the fluid delivered to the baby. This can help to avoid strong fluid sprays directly down the baby's throat. The size of orifice 702 can be selected to increase or decrease this effect, as desired.

We have found that an orifice 702 of about 0.010 inch (0.25 millimeter) in diameter can provide sufficient initial flow into the holding chamber upon initial inversion of the bottle that manual priming is unnecessary, the suckling action of the baby being sufficient to initiate flow and subsequently fill the holding chamber.

Figure 10:
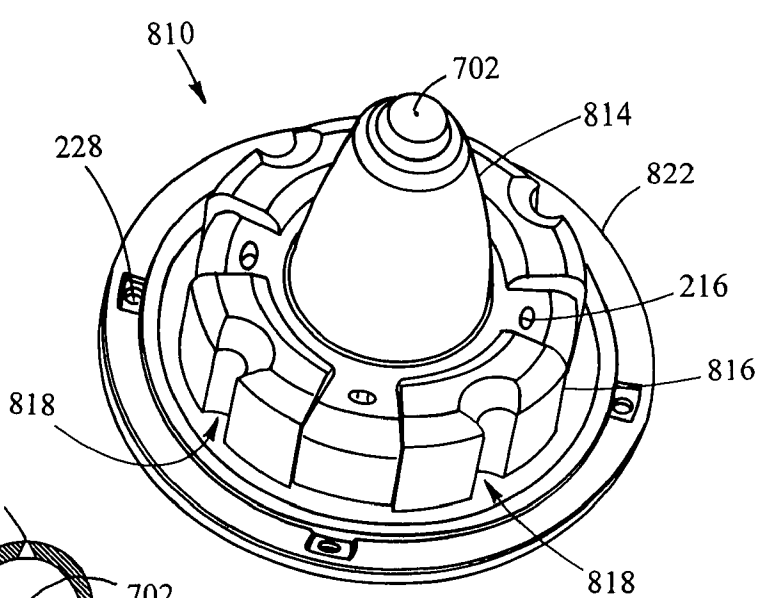
FIG. 10 is a perspective view of the inner member of the nipple of FIG. 8.
Figure 9:
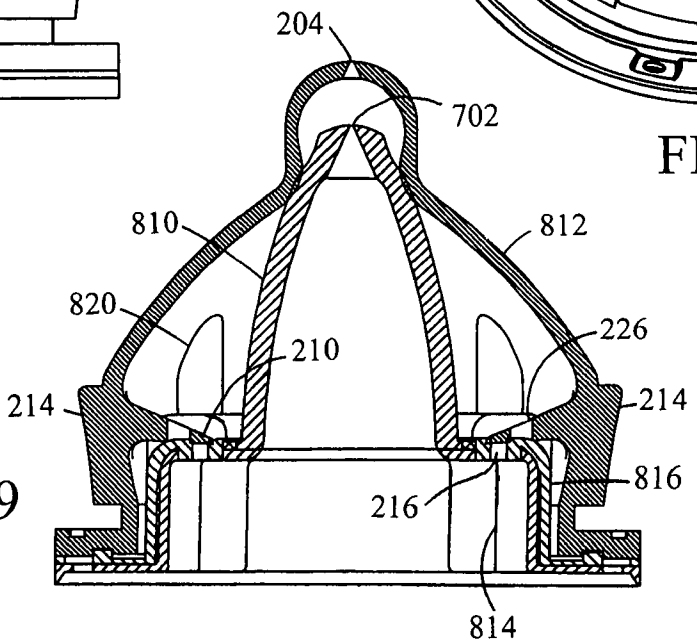
FIG. 9 is a cross-sectional view, taken along line 9—9 in FIG. 8.
Figure 8:
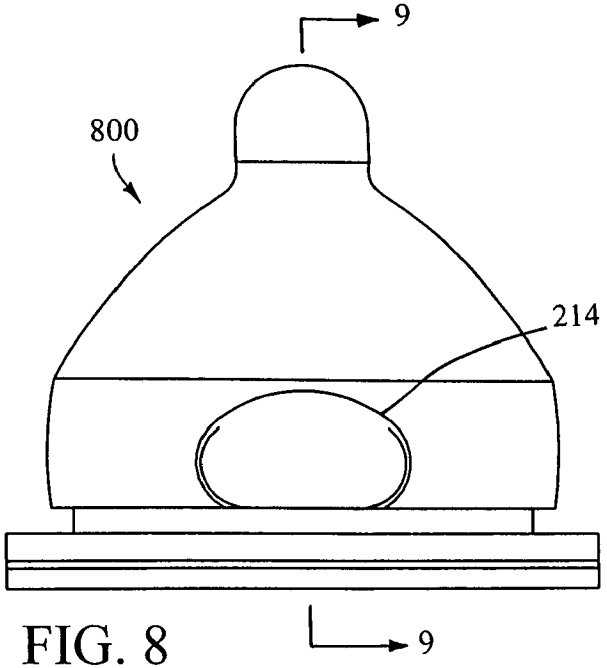
FIG. 8 is a side view of another nipple assembly.

FIGS. 8–10 show another nipple assembly. Referring first to FIGS. 8 and 9, nipple assembly 800 includes separable inner and outer components 810 and 812, generally as described above. In the cross-section of FIG. 9, the flexible portions of the nipple assembly are shown in their relaxed state, with overlap between the two parts indicating where the flexible membranes and flaps are preloaded in the assembly. Outer component 812 is molded entirely from silicone to have a durometer of about 55 shore A. Flap valve holes 226 are oval, with overall dimensions of about 1.6 millimeters by 2.4 millimeters.

Referring also to FIG. 10, inner member 810 consists of a central membrane 814 of thermoplastic elastomer (TPE) overmolded onto a rigid polypropylene base ring 816. Base ring 816 defines oval valve holes 216 and provides a stable surface for engaging the flexible valve flaps 210 of outer member 812. Valve holes 216 each measure about 1.6 millimeters by about 2.6 millimeters, and are completely blocked by flaps 210 of the outer member with the assembly at rest. As in the above-described embodiment, the valve holes 216 of rigid base ring 816 of the inner member at least partially align with flap valve holes 226 of the outer member when the outer member is squeezed at finger pads 214, such as for priming. Base ring 816 also defines four recesses 818, arranged at 90 degree intervals about the periphery of the inner member, for receiving corresponding vertical alignment ribs 820 of the outer member. The rigidity of base ring 816 thus helps to secure the alignment between the two members, in any of four functional orientations. The overmolded TPE extends under the peripheral flange 822 of the base ring, as shown in FIG. 9, and forms a gasket seal to engage the upper rim of the bottle. Vent holes 228 extend through both the ring flange 822 and the overmolded TPE. Central membrane 814 has a molded durometer of about 50 shore A. Significantly harder inner members are believed to be less acceptable to infants, while significantly softer inner members may not return to their as-molded state quickly enough after being deformed inwardly during suckling.

The outer nipple members shown in the various drawings are also adapted to function as typical one-piece nipples without the inner members present. This means that the inner member can be removed as the baby is weaned from the breast and no longer needs the breast-like, peristaltic pumping response of the full, two-piece nipple assembly as described above. Versions of the outer member with larger outlet orifice sizes can also be provided for increased flow rates, for use as children grow and can tolerate higher flow rates.

Various modifications to the apparatus and techniques described herein are possible. For example, different materials may be used to fabricate particular nipples. Nipples may be adapted to mate with various bottle designs, with various securing device designs. Thickness of materials may be changed. The size of the inner member, relative to the size of the outer member may be changed. Various configurations of passages, holes, and flaps may be implemented. The connector can be implemented in various configurations. Alternate vent arrangements may be utilized. Additionally, the general shape and size of the nipple components can be modified.

Accordingly, other implementations are within the scope of the following claims.

What is claimed is:

1. A nipple for use with a baby bottle, the nipple comprising:

an outer member with an annular securing flange and a flexible central membrane portion extending from the securing flange to define an aperture at a nursing end thereof, the central membrane portion comprising an inner surface and a flexible flap extending inwardly from the inner surface; and an inner member having a flexible inner membrane positioned at least partially within the central membrane portion of the outer member, the inner member defining a valve passage therethrough arranged to be selectively obstructed by the flap;

wherein the outer member and the inner member define therebetween a holding chamber having the valve passage as an inlet and the aperture as an outlet, the holding chamber comprising a first section in hydraulic communication with the inlet, and a second section in hydraulic communication with the outlet, a compromisable seal being disposed between the first section and the second section to isolate the first section of the holding chamber from the outlet when the central membrane portion is not deformed, and wherein the flap inhibits flow from the holding chamber through the valve passage when the central membrane portion is compressed to collapse the holding chamber, and allows flow into the holding chamber through the valve passage when the outer membrane is released.

2. The nipple of claim 1 wherein the flap defines a hole therethrough, the flap being manually positionable to align the hole with the valve passage to establish a hydraulic communication path into the holding chamber.

3. The nipple of claim 2 wherein the membrane portion of the outer member has an exposed surface with a delineated region adjacent the flap, the delineated region of the outer member being manipulable to move the flap to align the hole with the valve passage.

4. The nipple of claim 1 wherein the compromisable seal prevents passage of fluid therebetween when the central membrane portion of the outer member is in a relaxed position, and allows passage of fluid therebetween when the central membrane portion of the outer member is compressed to collapse the holding chamber.

5. The nipple of claim 1 wherein the compromisable seal is defined by an annular portion of the central membrane portion of the outer member that contacts an annular portion of the inner membrane of the inner member.

6. The nipple of claim 1 wherein the aperture provides a hydraulic communication path for passing fluid out of the holding chamber when the central membrane portion of the outer member is compressed.

7. The nipple of claim 1 wherein the aperture comprises a slit in the central membrane portion of the outer member that opens to allow passage of fluid when the outer membrane is compressed and closes to prevent passage of fluid when the outer membrane is in a relaxed position.

8. The nipple of claim 1 further comprising a plurality of valve passages and a plurality of corresponding flaps, wherein each valve passage is selectively obstructed by a corresponding flap.

9. The nipple of claim 8 wherein two of the flaps, positioned opposite each other, define priming holes therethrough and are manipulable to align the priming holes with respective valve passages to establish a hydraulic communication path into the holding chamber.

10. The nipple of claim 1 wherein the inner member comprises a rigid base ring from which the flexible membrane of the inner member extends.

11. The nipple of claim 10 wherein the membrane of the inner member is formed of a flexible material that extends across a lower surface of the base ring to form a gasket seal for engaging an upper rim of a bottle.

12. The nipple of claim 10 wherein the base ring defines recesses arranged to receive alignment features of the outer member, to rotationally align the inner and outer members.

13. The nipple of claim 1 wherein the outer and inner members are integrally formed.

14. The nipple of claim 1 wherein the membrane of the inner member is removable from within the outer member.

15. The nipple of claim 1 wherein the inner and outer members have corresponding rotational alignment features that inhibit inserting the inner member into the outer member except with the inner and outer members in operative relative alignment.

16. The nipple of claim 1 wherein the membrane of the inner member defines an orifice sized to pass a small amount of fluid therethrough when suction is applied to the aperture.

17. A bottle for feeding a baby, the bottle comprising:

a container for holding a fluid and including an open end;

a nipple having:

an outer member with an annular securing flange and a flexible central membrane portion extending from the securing flange to define an aperture at a nursing end thereof the central membrane portion comprising an inner surface and a flexible flap extending inwardly from the inner surface; and an inner member having a flexible inner membrane positioned at least partially within the central membrane portion of the outer member, the inner member defining a valve passage therethrough arranged to be selectively obstructed by the flap, the outer member and the inner member defining therebetween a holding chamber having the valve passage as an inlet and the aperture as an outlet, the holding chamber comprising a first section in hydraulic communication with the inlet, and a second section in hydraulic communication with the outlet, a compromisable seal being disposed between the first section and the second section to isolate the first section of the holding chamber from the outlet when the central membrane portion is not deformed, the flap inhibiting flow from the holding chamber through the valve passage when the central membrane portion is compressed to collapse the holding chamber, and allowing flow into the holding chamber through the valve passage when the outer membrane is released; and a securing device positioned to mate with the securing flange of the outer member to secure the nipple to the open end of the container.

18. A method of delivering fluid to a baby, the method comprising:

providing a nipple having an outer member and an inner member, the outer member having an annular securing flange and a flexible central membrane portion extending from the securing flange to define an aperture at a nursing end thereof, the central membrane portion comprising an inner surface and a flexible flap extending inwardly from the inner surface, the inner member having a flexible inner membrane positioned at least partially within the central membrane portion of the outer member, the inner member defining a valve passage therethrough arranged to be selectively obstructed by the flap; wherein the outer member and the inner member define therebetween a holding chamber having the valve passage as an inlet and the aperture as an outlet, the holding chamber comprising a first section in hydraulic communication with the inlet, and a second section in hydraulic communication with the outlet, a compromisable seal being disposed between the first section and the second section to isolate the first section of the holding chamber from the outlet when the central membrane portion is not deformed, the flap inhibiting flow from the holding chamber through the valve passage when the central membrane portion is compressed to collapse the holding chamber, and allowing flow into the holding chamber through the valve passage when the outer membrane is released;

securing the nipple to an open end of a container holding a fluid; and positioning the aperture of the nipple inside a baby's mouth, thereby enabling the baby's mouth to:

apply a compressive force to the central membrane portion of the outer member to compromise the compromisable seal and collapse the central membrane portion, thereby forcing fluid from the holding chamber and through the aperture; and release the central membrane portion of the outer member, thereby enabling the holding chamber to receive more fluid from the container through the valve passage.

19. The method of claim 18 further comprising manually priming the nipple.

20. The method of claim 19 wherein priming the nipple comprises:

positioning the container so that the fluid is in contact with the nipple; and manually manipulating a delineated region on an outer surface of the outer member to move the flap to align a hole in the flap with the valve passage.

21. The method of claim 20 wherein manipulating the delineated region comprises manually compressing the delineated region.

22. The method of claim 20 wherein priming the nipple further comprises allowing fluid to flow from the container, through the valve passage, through the hole in the flap and into the holding chamber while the hole remains aligned with the valve passage.

23. The method of claim 18 wherein securing the nipple comprises aligning rotational alignment features of the inner and outer members to place the inner and outer members in operative relative alignment.

24. A method of priming a nipple for a baby bottle, the method comprising:

providing a nipple having an outer member and an inner member, the outer member having an annular securing flange and a flexible central membrane portion extending from the securing flange to define an aperture at a nursing end thereof the central membrane portion including an inner surface, a flexible flap extending inwardly from the inner surface and defining a hole, and an outer surface having a delineated region adjacent the flap, the inner member having a flexible inner membrane positioned at least partially within the central membrane portion, the inner member defining a valve passage therethrough arranged to be selectively obstructed by the flap, the outer and inner members defining therebetween a holding chamber having the valve passage as an inlet and the aperture as an outlet, the flap and the valve passage cooperating to define a one-way valve for flow into the holding chamber;

securing the a nipple to an open end of a container holding a fluid;

orienting the container so that the fluid is in contact with the nipple; and applying a compressive force to the delineated region to deform the outer member in such a manner that the hole of the flap aligns with the valve passage of the inner member.

* * * * *